US005531396A

United States Patent [19]

Kinnunen et al.

[11] Patent Number: 5,531,396

[45] Date of Patent: Jul. 2, 1996

[54] METHOD AND DEVICE FOR REELING A PAPER OR BOARD WEB IN A DRUM REEL-UP OR EQUIVALENT

[75] Inventors: Jorma Kinnunen, Helsinki; Silvo Mikkonen, Järvenpää, both of Finland

[73] Assignee: Valmet Corporation, Helsinki, Finland

[21] Appl. No.: 356,887

[22] Filed: Dec. 15, 1994

[30] Foreign Application Priority Data

Dec. 16, 1993 [FI] Finland ..... 935669

[51] Int. Cl.[6] ..... B65H 19/26; B65H 19/28

[52] U.S. Cl. ..... 242/526.300; 242/532.2; 242/541.3

[58] Field of Search ..... 242/541.3, 532.2, 242/526.3, 526, 532

[56] References Cited

U.S. PATENT DOCUMENTS

| | | | |
|---|---|---|---|
| 2,789,333 | 4/1957 | Fuhrmann | 242/541.3 |
| 4,143,828 | 3/1979 | Braun et al. | 242/541.3 |
| 4,175,714 | 11/1979 | Dreher | 242/541.3 |
| 4,196,865 | 4/1980 | Patriksson | 242/541.3 |
| 4,283,023 | 8/1981 | Braun et al. | 242/541.3 |
| 4,456,190 | 6/1984 | Karttunen et al. | 242/532.2 |
| 4,695,004 | 9/1987 | Grossman et al. | 242/526.3 |
| 4,921,183 | 5/1990 | Saukkonen et al. | 242/541.3 |
| 5,014,924 | 5/1991 | Nowisch et al. | 242/526.3 |
| 5,251,835 | 10/1993 | Kyytsonen . | |
| 5,360,179 | 11/1994 | Vesterinen et al. | 242/532.2 |

FOREIGN PATENT DOCUMENTS

| | | |
|---|---|---|
| 60687 | 10/1978 | Finland . |
| 905284 | 4/1992 | Finland . |

*Primary Examiner*—John M. Jillions
*Attorney, Agent, or Firm*—Steinberg, Raskin & Davidson

[57] ABSTRACT

A method and device for reeling a paper or board web in a drum reel-up or equivalent, in which, when a paper or board reel formed on a reel spool situated in a reeling position becomes complete, a new reel spool is brought by transfer members into a stand-by position and accelerated up to the web speed. The reel spool with the complete reel is transferred into an exchange position apart from the reel drum and the new, initially accelerated reel spool is transferred into the reeling position. When the reel spool with its reel is transferred into the exchange position apart from the reel drum, the belt guide roll is transferred into nip-defining relationship with the complete reel that is being formed onto the reel spool and is displaced along with the reel spool into the exchange position so that the web runs during the entire exchange on support of the belt and through a nip between the guide roll and the reel spool. The device includes a reel drum, a reel spool whereby the web runs through the nip between the reel drum and the reel spool onto the reel spool, a transfer device for bringing a new reel spool into nip-defining relationship with the reel drum after the paper or board reel on the first reel spool has become complete, and means for transferring the belt guide roll together with the reel spool into the exchange position so that, during the entire exchange, the web is supported on the belt and runs through the nip between the guide roll and the reel spool.

20 Claims, 8 Drawing Sheets

METHOD AND DEVICE FOR REELING A PAPER OR BOARD WEB IN A DRUM REEL-UP OR EQUIVALENT

BACKGROUND OF THE INVENTION

The invention relates to a method for reeling a paper or board web in a drum reel-up or equivalent, in which, when a paper or board reel formed on a reel spool situated in a reeling position in nip-defining relationship with the reel drum becomes complete, a new, empty reel spool is brought by means of transfer members into a stand-by position and accelerated up to the web running speed. The reel spool with the complete reel is transferred by means of a transfer device into an exchange position apart from the reel drum, and the new, empty, initially accelerated reel spool is transferred into the reeling position.

The invention also relates to a device for reeling a paper or board web in a drum reel-up or equivalent, which device comprises a reel drum and a reel spool whereby a paper web is fitted to run through a nip defined between the reel drum and the reel spool and then onto the reel spool. The device comprises a transfer device for bringing a new, empty reel spool into nip-defining relationship with the reel drum after the paper or board reel on the first reel spool is complete.

As is well known in the art, when a web is reeled by means of a drum reel-up or an equivalent reel-up, the web is passed on the face of the mantle of a reel drum, a reeling cylinder or equivalent before the reeling nip, while the web forms a belt angle over the reeling cylinder or equivalent. Problems have arisen from sliding between the web and the reeling cylinder which causes fluctuations in the tension of the web. Further, during replacement of a full reel for a new empty reel spool, fluctuations have occurred in the tension of the web, which in this instance may also result in problems in the paper forming processes preceding the reeling process.

A drum reel-up is used commonly to reel the paper web that comes, for example, from a paper machine, a coating machine, a supercalender and from a printing machine. In a drum reel-up, the web is reeled onto a spool, and the reel that is being formed, i.e., the structure of the web being wound onto the reel spool in combination therewith, is pressed against the reel drum or reeling cylinder, over which the web runs on a certain sector and which is rotated at a circumferential speed that corresponds to the speed of the web. Before completion of the reel, a new, empty spool can be brought into nip-defining relationship with the reel drum so that it also obtains the corresponding circumferential speed. As soon as the reel of paper has obtained the desired diameter, it is transferred apart from the reel drum. Then its speed of rotation starts becoming lower, which has the consequence that, between the new reel spool and the full reel, a web loop is formed. This loop is guided by means of a compressed-air jet to be wound around the new, empty reel spool and is then torn apart from the full reel of paper so that the web starts to wind onto the new, empty reel spool.

It is conventional in drum reel-ups that at the reeling stage, normally the spool of the paper reel rests and revolves on two support rails. To permit this, there are particular bearing parts at ends of the reel spool, which bearing parts also guide the transfer of the reel as it is transferred along the rails to further processing upon completion of the reel. In paper manufacture, this further processing is usually slitting which entails cutting the reel and unwinding it into smaller rolls of paper. The returning and changing of the empty reel spools can be carried out, for example, by means of a crane or other suitable machinery.

When certain paper grades are being reeled, for example LWC and SC paper grades, it is a problem that the paper to be reeled slides on the face of the reeling cylinder especially at higher web running speeds. This sliding problem occurs especially in the reel-ups driven by the circumference described above, i.e., those in which the new replacement paper reel obtains the power required for its rotation from the circumference of a driven reeling cylinder and transfers it to its own circumference through friction force between the paper and the face of the reeling cylinder. When the friction force is lower than a certain limit value, sliding occurs between the face of the reeling cylinder and the paper to be reeled which results in uncontrollable variations in tightness and hardness in the paper reel that is being formed. These variations in tightness and hardness produce unwanted wrinkles in the reels, especially in the inner layers, so that the inner portion of the reel becomes broke. As a result, substantial economic losses are incurred for the paper mill.

The above sliding of the paper against the face of the reeling cylinder depends on the tension of the paper in the area of the reeling cylinder and on the resulting surface pressure against the face of the reeling cylinder. Another factor that affects the sliding is the linear load that is produced by the primary and secondary reeling forks on the growing paper reel against the reeling cylinder. Further, the occurrence of sliding is affected by the surface properties of the paper that is reeled and the reeling cylinder, i.e., the friction coefficient between these surfaces, which is also affected by the humidity of the paper.

An increased tension of the paper increases the tendency of sliding but, on the other hand, it reduces fluttering of the paper. However, the tensile strength of the paper sets an upper limit for an increase in tension vis-a-vis increased breaks in the paper web. Maintaining the linear load between the reel that is being formed and the reeling cylinder sufficiently high and stable is complicated because the reeling is started on primary forks that are in an upper position and is continued on secondary forks in a later stage. The primary forks bring the reel downward to an inclined contact with the face of the reeling cylinder, and the reel begins to receive its rotation power from the circumference of the reeling cylinder. As the reel becomes larger and the primary forks are lowered gradually to their lower position, attempts are made to keep the linear load between the reel and the reeling cylinder invariable despite a reduction in the force component arising from the gravity of earth as the position of the growing reel changes in relation to the reeling cylinder. This takes place by means of separate relief cylinders.

One of the most difficult parts of the control of the linear load is the stage in which the growing reel is transferred from the primary forks to the secondary forks. In practice, in this stage, there are noticeable variations in the linear load, which variations permit momentary sliding of the paper on the face of the reeling cylinder. This results, from time to time, in the above-described wrinkling of the paper in the initial stage of the reeling.

At the reeling stage, for example drum reeling, the transfer from primary forks to secondary forks causes discontinuity in the reeling of the web and, as a result, bottom broke in the paper reel.

The transfer of the reel from primary forks to secondary forks may also cause variations in the tension of the paper, which variations may be a reason for sliding and for wrinkling of the paper.

One of the prior art means for avoiding the above-discussed sliding problem and its consequences is to set the tension of the paper as low as possible by regulating the difference in speed between the reeling cylinder and the nearest drive mechanism preceding it. As stated above, in this connection, a restricting factor is the fluttering of the web and the resulting increased tendency of web breaks and deterioration of the quality properties of the paper, e.g., the formation of folds.

Another procedure used to avoid the sliding problem and its consequences is to increase the linear load between the growing reel and the reeling cylinder to a level as high as possible by using an excessively high loading force on the carrier forks, especially on the secondary forks, with which loading force the reel is pressed against the reeling cylinder. Reduced quality properties of the paper are a drawback in this procedure because the tensile strength and the stretch of the paper are reduced.

With respect to the prior art most closely related to the method and device in accordance with the present invention, reference is made to Finnish Patent Application No. 905284 (corresponding to U.S. Pat. No. 5,251,835 assigned to the same assignee herein and the specification of which is hereby incorporated by reference herein) which describes a method for reeling a web wherein, when the machine roll becomes full, a new empty reel spool is brought by means of transfer members into the stand-by position and accelerated to the web speed. At the same time as the machine roll connected to the center drive is transferred by means of the machine roll transfer device to the exchange position apart from the reel drum, the new pre-accelerated reel spool is lowered onto the rails, and the exchange is carried out in a manner in itself known. Thereafter, the full machine reel is slowed down and the transfer device for the full machine reel is shifted to the new reel spool, and the center drive is connected to the new reel spool. In this method, the web is not supported during the reeling on any surface.

From the prior art, so called WINBELT reel-ups are also known, in which reel-ups a carrier belt which runs between belt rolls is used. One of these belt rolls is usually provided with a drive and the other belt roll is mounted on fastenings. The positions of the belt rolls are substantially stationary, and their position is changed only to the extent that is required to adjust the tension of the belt. By means of this arrangement of belts, attempts are made to provide a difference in speed in relation to the reeling, and by means of this difference in speed, attempts are made to provide optimal linear loads as the reeling progresses.

With the present paper and surface treatment machines, attempts are made to achieve ever higher speeds, so called high-speed reeling, in which reeling the speed is higher than about 1600 meters per minute. High-speed reeling results in increased air resistance and friction, for example, an increase in speed makes the air resistance four-fold, which may lead to problems in the running of the web. While aiming at ever higher web running speeds, attempts are made to use recycled fibres as extensively as possible. However, such recycled fibers are not as strong as virgin fibres. Further, at the same time, attempts are made to provide thinner paper grades, in which case the paper grade that is used is weaker. In such cases, it is important to arrange the reel spool exchange in such a way that there is no discontinuity in the reeling of the web, and at the same time, to more accurately control the reeling parameters.

OBJECTS AND SUMMARY OF THE INVENTION

Accordingly, it is an object of the present invention to provide a solution for the above problems in the exchange of reel spools during a reeling process to obtain a more efficient reeling method and device.

Another object of the invention is to improve the structure of the reel and to provide a stable running of the web during reeling, reel changes and threading.

In view of achieving the objects stated above and others, in the method in accordance with the invention, when the reel spool with its complete reel is transferred from a reeling position in nip-defining relationship with the reel drum into an exchange position apart from the reel drum, the belt guide roll is transferred into nip-defining relationship with the reel that is being formed onto the reel spool. The guide roll is then displaced along with the reel spool into the exchange position so that the web runs during the entire exchange on support of the belt and through the nip between the guide roll and the reel spool. Thus, in the method in accordance with the invention, a web is carried on a belt until it is reeled onto the first reel spool, the belt is guided in a run over the reel drum and a belt guide roll, a "first" reel spool is displaced from the reeling position to an exchange position spaced from the reel drum, and the belt guide roll is displaced into nip-defining relationship with the reel being formed on the first reel spool at the time the first reel spool is displaced to the exchange position so that the belt carries the web until and through the nip defined between the guide roll and the reel on the first reel spool.

There are several manners for transferring the web from the first, complete reel spool to a second, empty reel spool. First, the second reel spool is transferred from its stand-by position to the reeling position when the first reel spool is displaced from the reeling position to the exchange position, and then the web is guided around the second reel spool by moving a roll relative to the second reel spool to cause the belt to surround a substantial proportion of the circumference of the second reel spool such that the web reels onto the second reel spool. Alternatively, a leader of the web is formed, e.g., by a water jet, and blown onto a face of the second reel spool, e.g., by an air-blowing device. In this regard, the final end of the web remaining after the leader has been cut into the web winds around the first reel spool. Suction may be applied in at least one suction zone to hold the web in contact with the belt during the changing of the reeling from the first reel spool to the second reel spool. The web also ideally runs at least partially on the belt during the entire changing of the reeling from the first reel spool to the second reel spool.

The device in accordance with the invention comprises means for transferring the belt guide roll, together with the reel spool, into the exchange position so that, during the entire exchange of the reeling from a first reel spool to a second reel spool, the web is supported on the belt and fitted to run through the nip between the guide roll and the reel spool. Accordingly, the device comprises a belt for supporting the web during reeling thereof, a movable belt guide roll arranged in a loop of the belt whereby the belt guide roll is movable to define a nip with the reel on the first reel spool, and means for simultaneously transferring the belt guide roll and the first reel spool when defining the nip therebetween into an exchange position such that the web is supported on the belt and runs through the nip between the belt guide roll and the reel on the first reel spool before being reeled onto the first reel spool. Preferably, several guide rolls are arranged in the loop of the belt, and means are provided for displacing at least one of these guide rolls to adjust the tension of the belt.

To assist in the transfer of the reeling of the web from the first, complete reel spool to the second reel spool, the device may include cutting means for cutting the web to form a leader when the paper or board reel on the first reel spool is complete and the second reel spool is in nip-defining relationship with the reel drum, and air-blow means for blowing the leader of the cut web onto a face of the second reel spool such that the web winds thereon.

An important feature of the arrangement in accordance with the invention is that the web transfer is supported until the nip, which makes high-speed reeling possible also with weaker paper or board grades.

The invention can be applied both to threading, to supporting the web and to controlling the reeling parameters. The invention is also particularly favorable in connection with reel change, because the web is supported by the belt during the entire changing procedure.

By means of a belt arrangement in accordance with the invention, an extended nip is provided, and the nip pressure can be made, for example, lower, because the length of the nip is proportional to the tension of the web used. By means of this belt effect, the reeling geometry can be regulated.

In threading, the arrangement in accordance with the invention supports the leader strip of the web in its running, and it is possible to use a wedge strip made in the middle or at the edge, and the leader is supported through substantially the entire threading process.

The belt roll guiding the belt can be closed or open. Thus, the belt arrangement in accordance with the invention can also form an extra nip which prevents access of air into the reeling nip.

In the following, the invention will be described in more detail with reference to the figures in the accompanying drawings. However, the invention is not strictly confined to the details of the illustrations in these figures.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
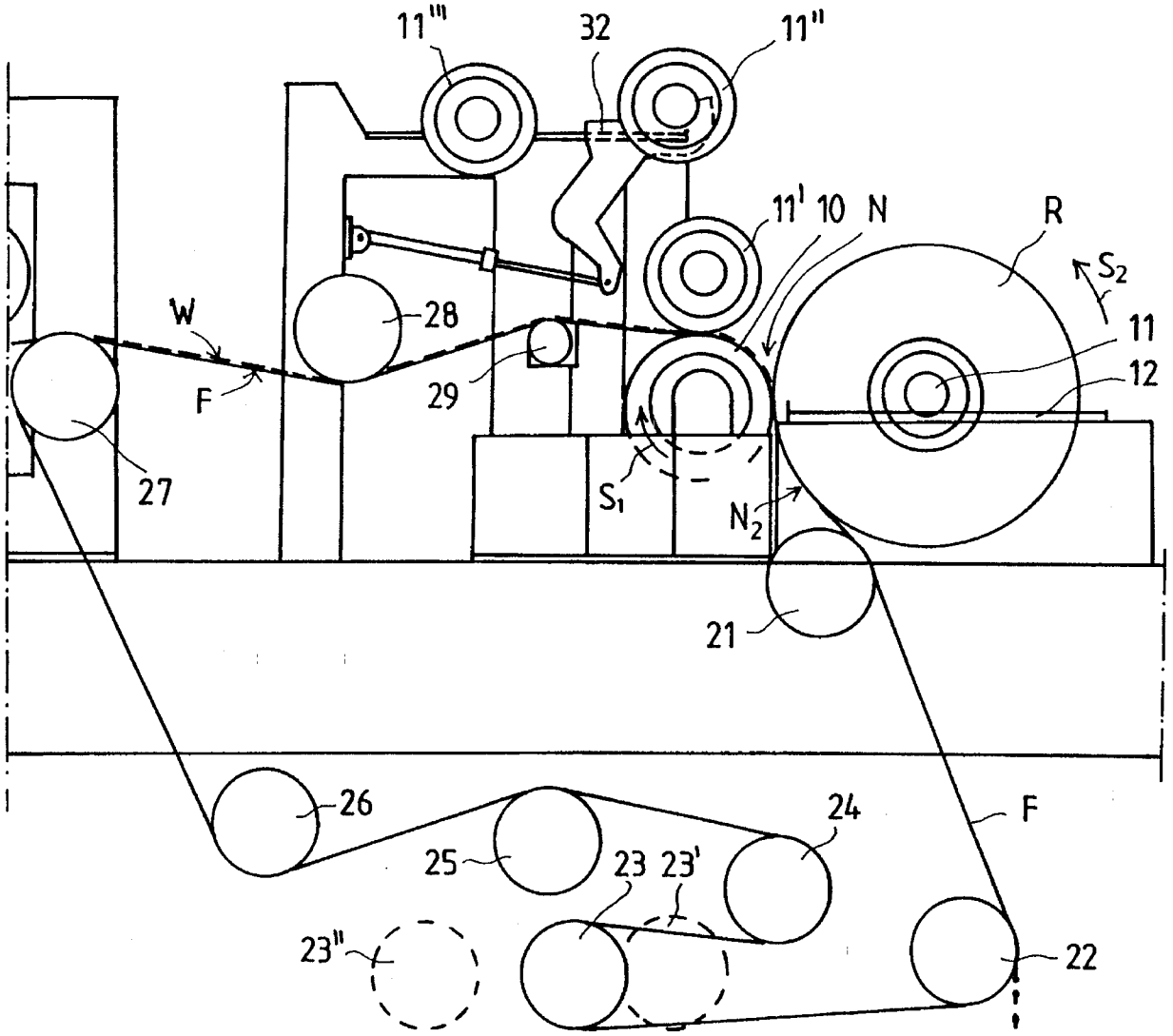
FIG. 1 is a schematic illustration of the stage in the reeling in which the machine reel becomes full in accordance with the invention.

Referring to the accompanying drawings wherein the same reference numerals refer to the same elements, FIGS. 1–5 are illustrations concerning different stages in the change of reeling, in which illustrations the change of reeling is presented while referring to a drum reel-up in which the main part of the reel-up is formed by a reeling cylinder 10 along whose circumference a paper web W runs before being transferred onto the circumference of a paper reel R that is formed around a reel spool 11. The spool 11 rests and revolves in its reeling position, e.g., on two carrier rails 12. The belt arrangement in accordance with the invention comprises a belt F, which can be a wire, felt or any other fabric permeable to air. The belt F runs under guidance of guide rolls 21, . . . , 29 and through a nip N defined between the reeling cylinder and the paper reel R. The belt F supports the paper web W as the web comes into the reeling device and until the paper web W is wound around the paper reel R that is being formed on the reel spool 11. The belt F extends in the cross direction substantially across the entire machine width.

All reeling cylinder types known in themselves, for example grooved, perforated, smooth cylinders, can be used in the arrangement in accordance with the invention. Different types of suction rolls may also be utilized. A grooved reeling cylinder is preferable because it is easier to control the air flows in the area of the nip for such a cylinder. In the present specification, besides a conventional linear nip, the term "nip" also refers to a support zone.

In the stage shown in FIG. 1, the reeling cylinder 10 revolves in the direction indicated by the arrow $S_1$ (clockwise), and the web W is reeled onto the reel shaft, i.e. the reel spool 11. The web W is reeled onto the reel spool 11 by means of the reeling cylinder 10 through the nip N. The reel spool 11 revolves in the direction indicated by the arrow $S_2$ (counterclockwise). As shown in FIG. 12, the paper reel R that is formed on the reel spool 11 is almost full, and transfer means, e.g., transfer members 32, have brought a new reel spool 11' to a stand-by position to timely replace reel spool 11. The guide roll 21 functions as a rider roll and at the same time is in a stand-by position near the reel spool 11. Supported by means of the belt F, the paper web W runs from the reeling cylinder 10 onto the paper reel R that is formed on the reel spool 11. The belt F forms an extended nip $N_2$ beginning substantially at the nip N formed between reeling cylinder 10 and the paper reel R, and extending along the circumference of the reel to terminate at or before the guide roll 21, whereby the length of the nip $N_2$ is adjustable by means of the guide roll 21 and the belt arrangement.

Figure 2:
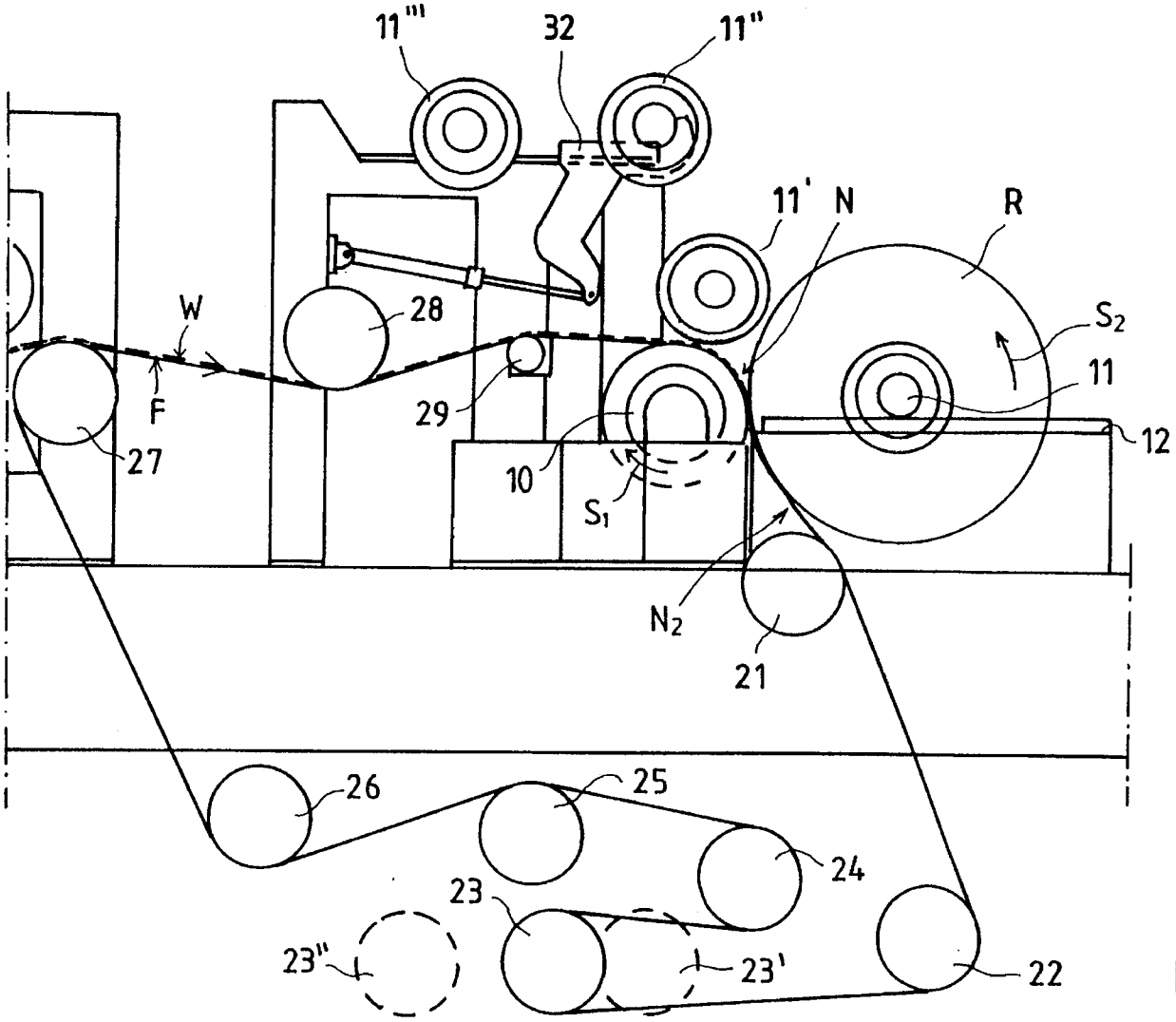
FIG. 2 is a schematic illustration of the change that takes place in reeling while the reel spool is in the stand-by position in accordance with the invention.

In the stage shown in FIG. 2, the paper reel R, formed on the reel spool 11 which revolves on the rails 12, is almost full. When the paper reel R becomes full, a new reel spool 11' is brought by means of the transfer members 32 to the stand-by position, and the new reel spool 11' is accelerated to the web speed. The paper web W still runs supported by the belt F. The acceleration of the new empty reel spool 11' is achieved by engaging the outer surface of the reel spool 11' with the reeling cylinder 10 to bring the rotational speed of the new reel spool 11' to be substantially equal to the rotational speed of the reeling cylinder 10.

Figure 3:
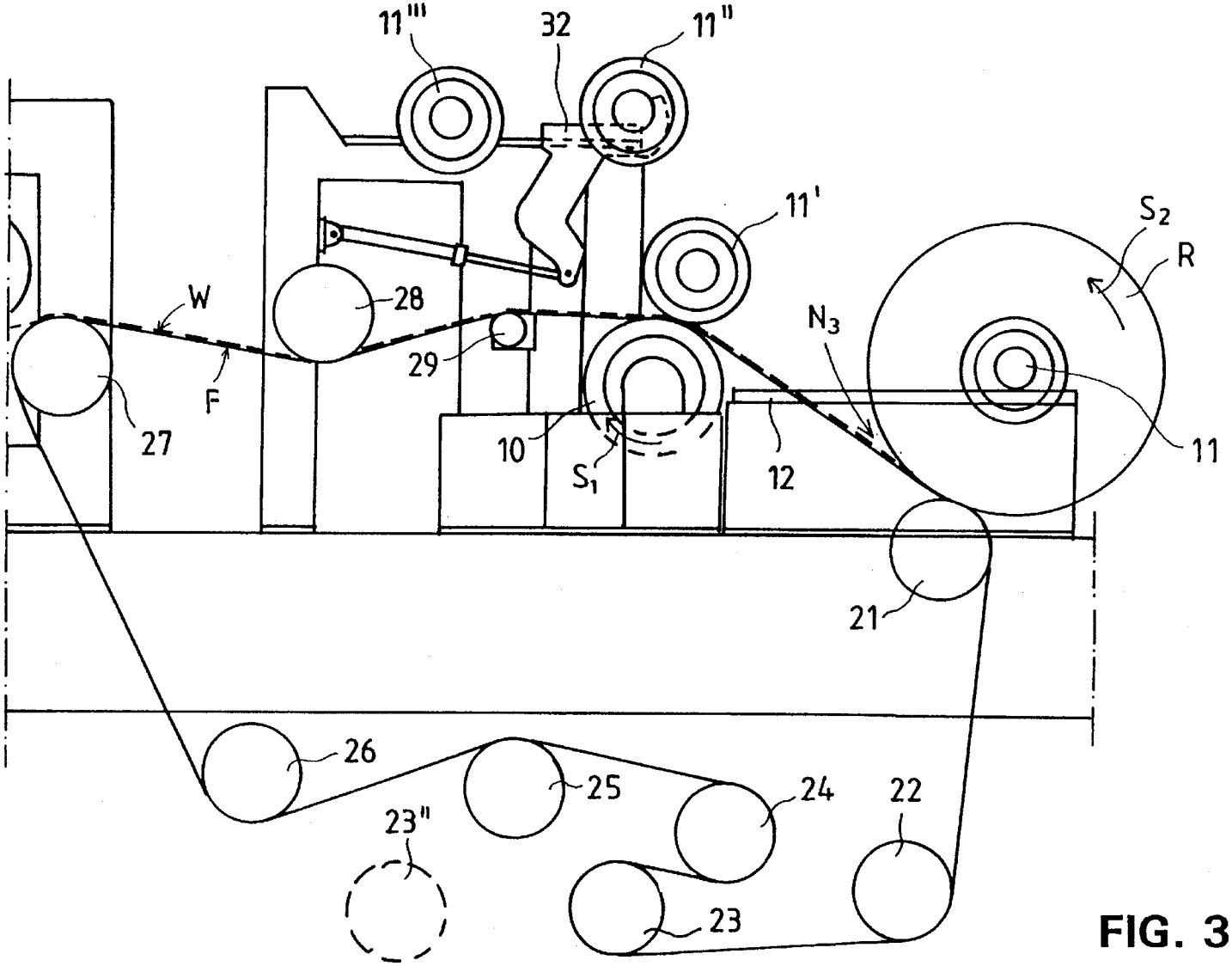
FIG. 3 is a schematic illustration of a stage in the change in reeling in which the machine reel is in the change position in accordance with the invention.

In the stage illustrated in FIG. 3, the reel spool 11 with the full paper reel R has been transferred in a conventional manner along the rails to an exchange position, and the guide roll 21 has been brought into nip-defining relationship with the paper reel R that has been formed on the reel spool 11. The displacement of the guide roll 21 into nip-defining relationship with paper reel R, via suitable displacement means, forms an additional nip $N_3$ which prevents air from entering into the paper reel R and, at the same time, shifts the running of the belt F in such a way that the paper web W is also supported on the run between the reeling cylinder 10 and the reel spool 11. The guide roll 21 is brought into its position before the reel spool 11 is separated from the reeling cylinder 10, and it is transferred along with the complete paper reel R to the exchange position.

Figure 4:
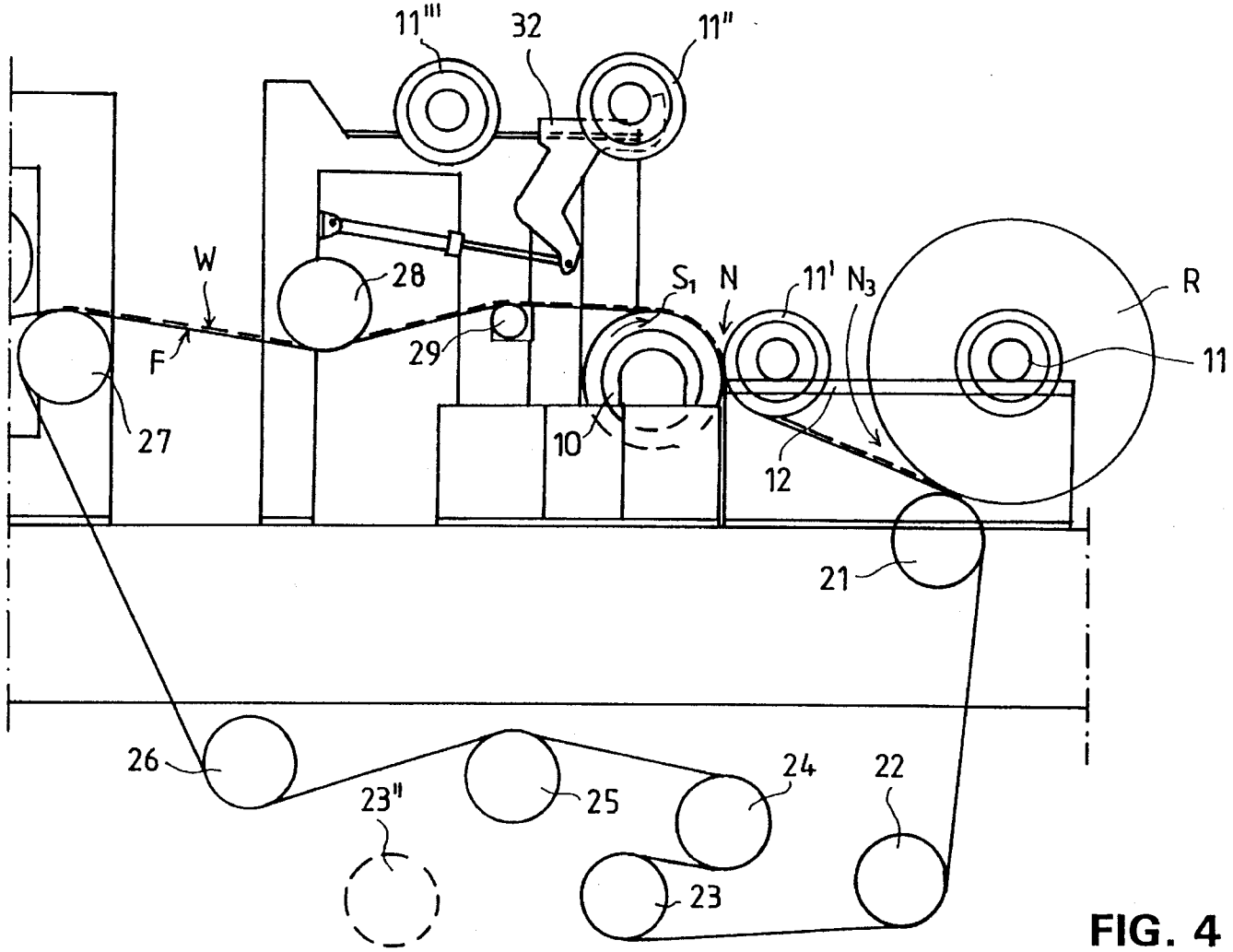
FIG. 4 is a further illustration of a situation of change in which both the reel spool and the machine reel are in the change position in accordance with the invention.

As illustrated in FIG. 4, the new initially accelerated reel spool 11' is lowered to the reeling position, e.g., onto the rails 12, and the change of the reeling takes place so that the reel spool 11' is transferred to the stand-by position in order to begin a new reeling of the web thereon. At this stage though, the paper web W still runs supported by the belt F onto the complete paper reel R.

Figure 5:
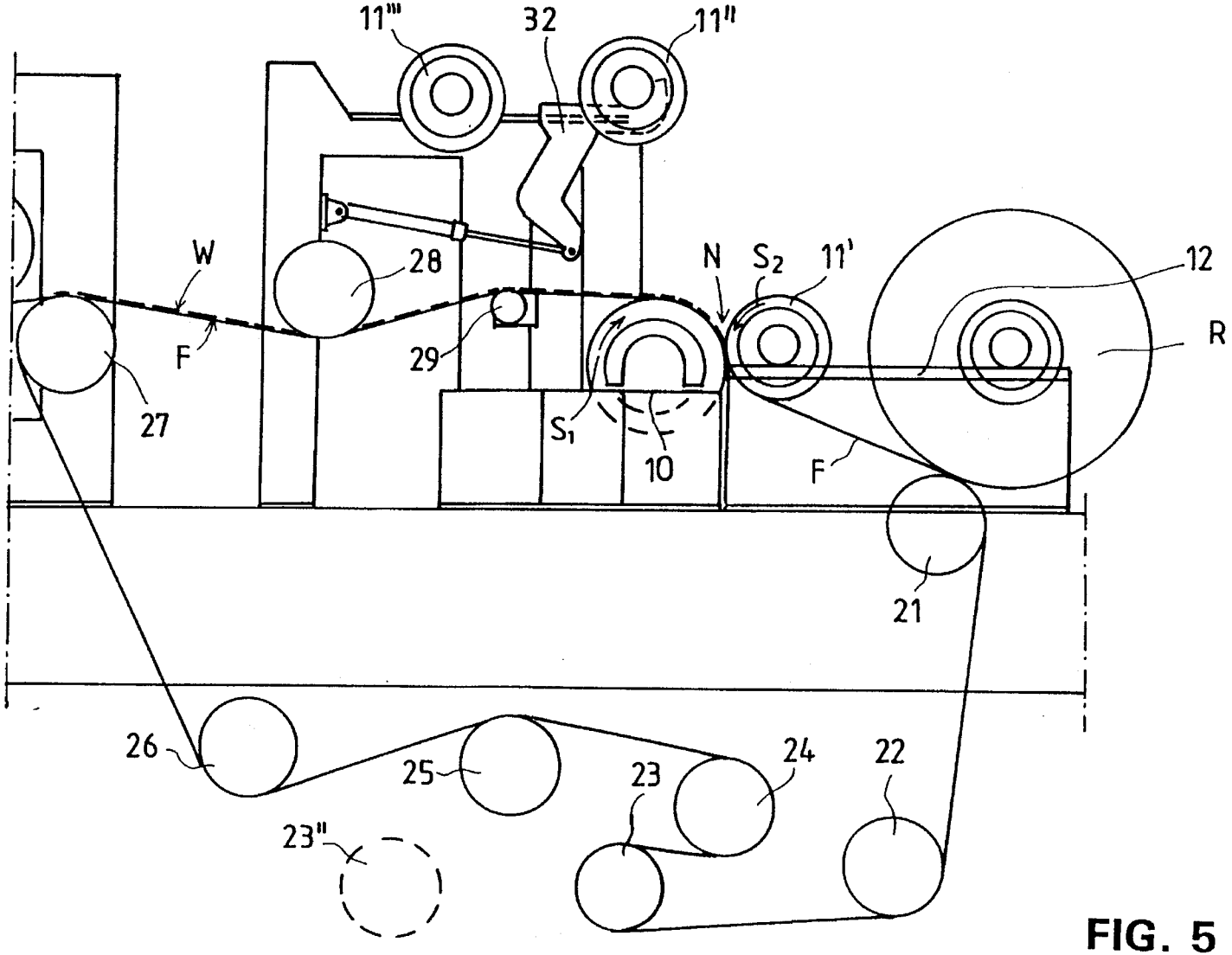
FIG. 5 is a schematic illustration of the stage of the change in the reeling, in which the change has taken place and the web moves to the new reel spool in accordance with the invention.

In the stage shown in FIG. 5, the change in the reeling has taken place by cutting the paper web between the complete paper reel R and the reel spool 11', and causing the paper web W to wind onto the new reel spool 11'. As shown in FIG. 5, the new reel spool 11' has been brought into nip-defining relationship with the reeling cylinder 10, and the new reel spool 11' revolves at the web speed. The full paper reel R on the reel spool 11 is slowed down, and the transfer members 32 are brought back to their initial position in order to transfer the next empty reel spool 11" to the stand-by position for the next reeling change.

As shown in FIGS. 1–5, it is possible to adjust the tension of the belt F from its position 23' indicated by the dashed line to the position 23", e.g., by means of the guide roll 23. Thus, the reeling parameters can be adjusted by adjusting the tension of the belt F. Of course, the change in the length of the belt is also compensated for by means of the guide roll 23 when the guide roll 21 is transferred to the exchange position along with the complete paper reel R, FIGS. 3–5. Thus when the guide roll 21 is displaced into nip-defining relationship ($N_3$) with the reel R, via suitable displacement means, guide roll 23 may be correspondingly moved to compensate for this displacement, also via suitable means, to maintain the integrity of the belt F. The belt F runs, guided by its guide rolls 21, . . . , 29, substantially at the same speed with the reeling. In FIG. 1, the dashed line oriented downward from the guide roll 22 represents a situation in which, if necessary, the paper web W is passed into the pulper.

In the arrangement in accordance with the invention, an elastic belt can also be used., in which case the guide roll 23 does not have to compensate for the changes in the length of the belt F during changing of the reel spools.

Figure 6:
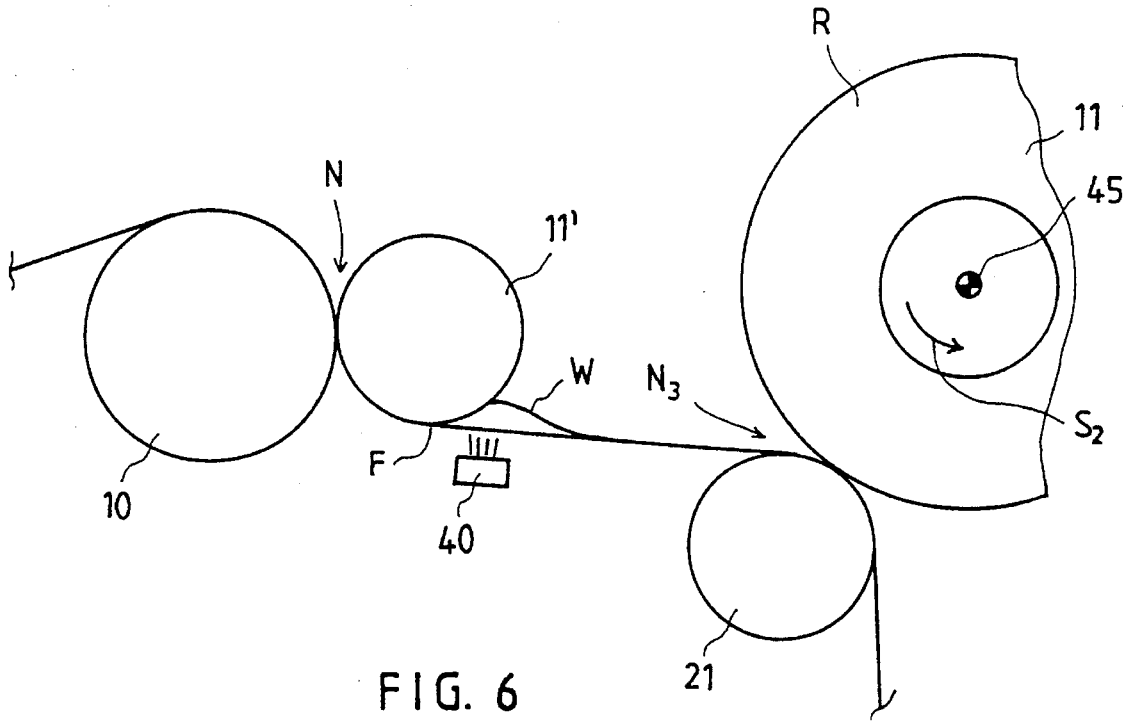
FIG. 6 is a schematic illustration of an alternative mode of change in reeling in accordance with the invention.

In FIG. 6, an alternative mode of replacing the full reel with an empty reel spool is shown schematically concerning a situation that takes place between the stages illustrated in FIGS. 4 and 5. The web W that runs supported by the belt F is separated from the belt F after the new reel spool 11' by blowing air from nozzle means through the belt F and simultaneously slowing down a center drive 45 of the reel spool 11 of the complete paper reel R. In this case, the web W is separated from the belt by the effect of the air blows from a blowing device 40, and it can be cut off in any conventional manner, e.g., by means of water-jet cutting or a cutter blade.

Figure 7:
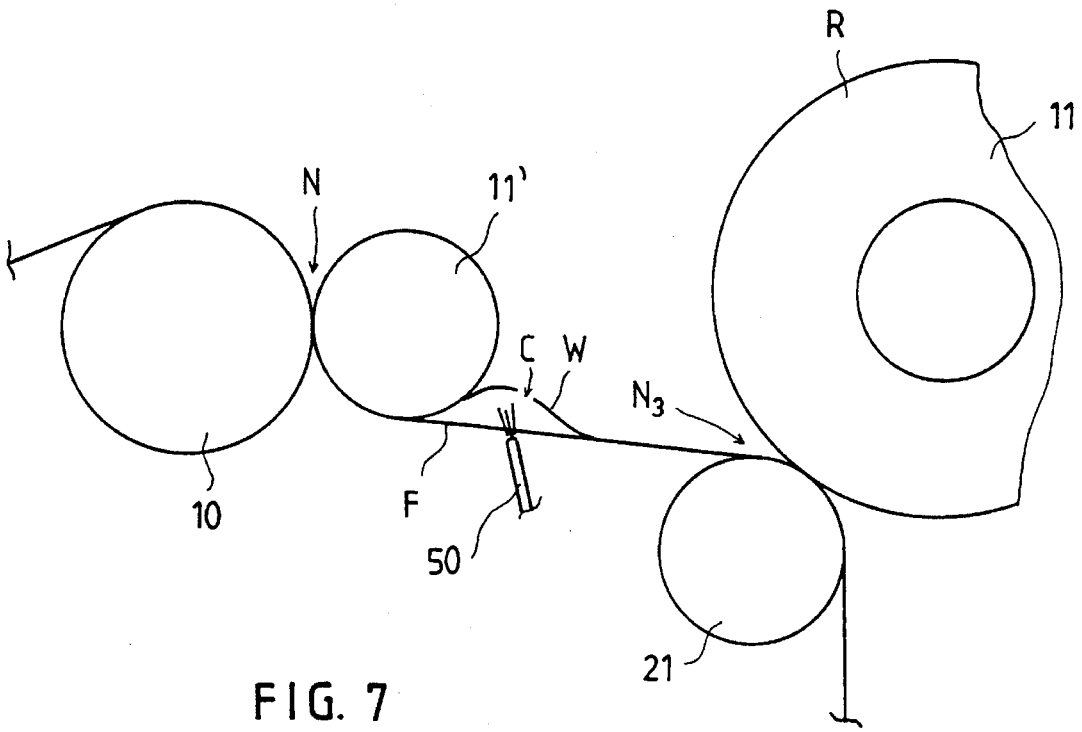
FIG. 7 is a schematic illustration of another alternative mode of change in reeling in accordance with the invention.

In FIG. 7, another alternative mode of replacing the full reel with an empty reel spool is shown schematically concerning a situation that takes place between the stages illustrated in FIGS. 4 and 5. In the example shown in FIG. 7, the web W supported by the belt F is separated from the belt F by blowing air by means of a blow device 50 from one edge of the web W in a plane of the paper web W. The web W is thus separated from the belt F and can be cut off, e.g., by means of a cutter blade, water-jet cutting or any other method in itself known. In this manner, the web is cut off at the point C while the final end of the web is wound around the complete reel R, and the end of the web placed at the other side of the cutting point is blown by the blow device 50 to turn around the new reel spool 11'.

Figure 8:
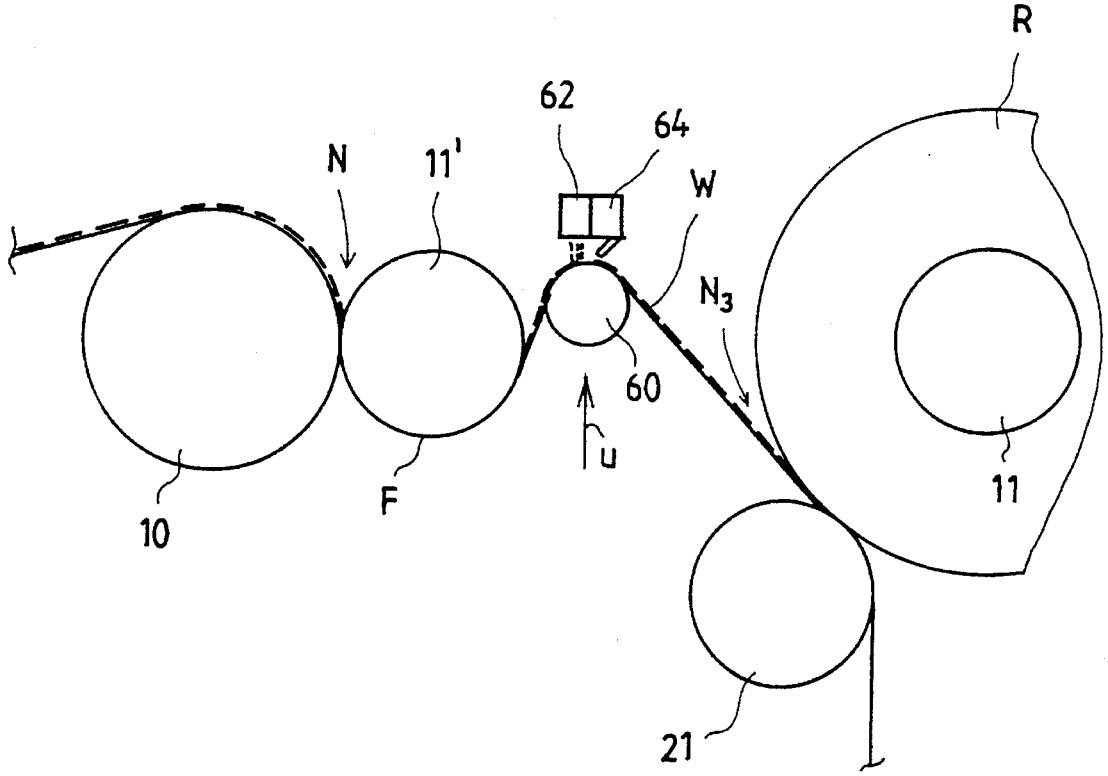
FIG. 8 is a schematic illustration of a further alternative mode of change in reeling in accordance with the invention.

FIG. 8 shows another example of changing in the reeling of a web in which the new reel spool 11' can be surrounded by the belt F by means of a roll 60 raised in the direction of the arrow U. The paper web W is cut against the roll 60 by means of the water jet from a water-jet cutting device 62, and the leader of the web W is blown as it runs over roll 60 by means of a blow device 64 to follow the face of the new reel spool 11', and the final end of the web W is wound around the complete reel R.

Figure 9:
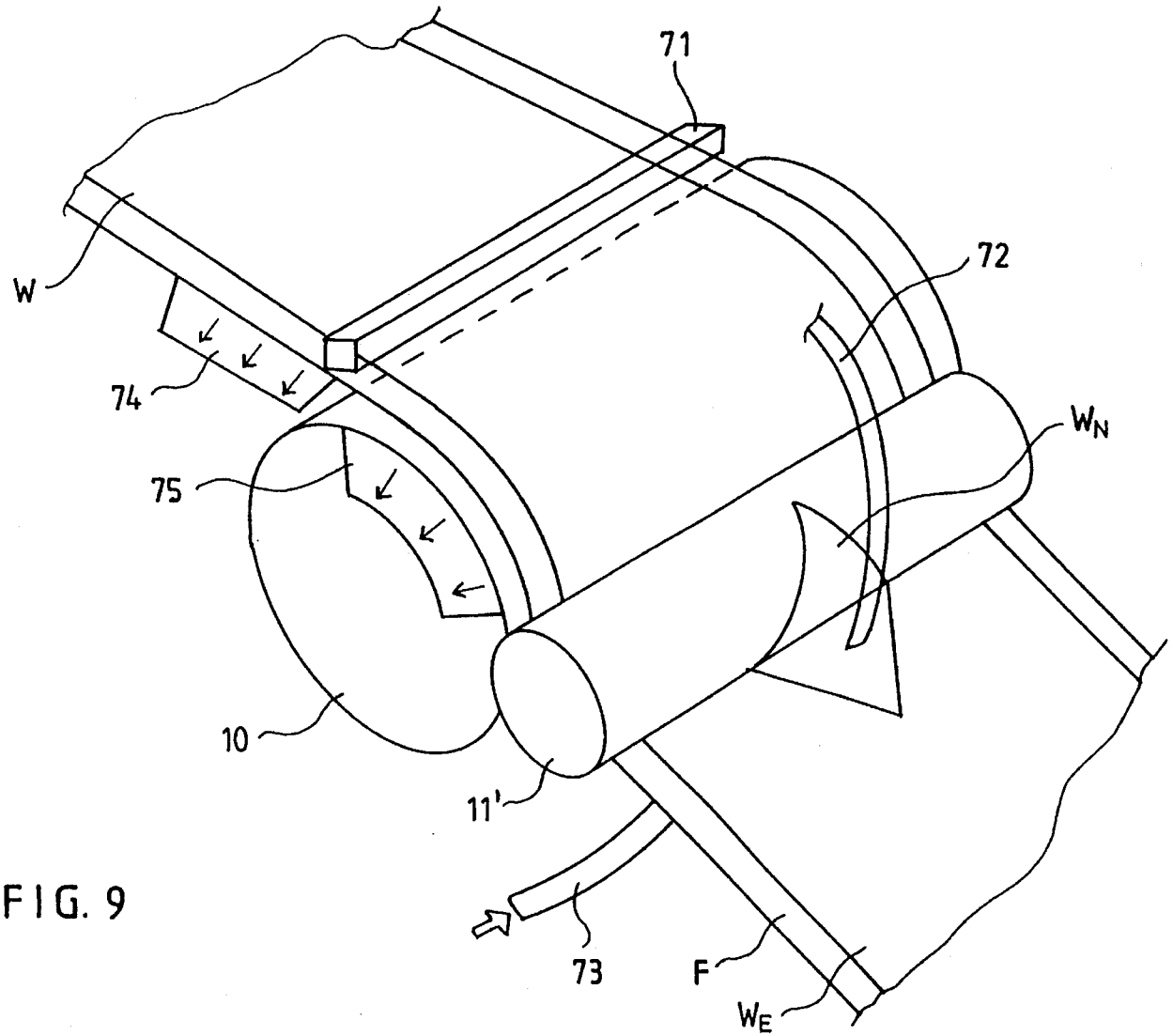
FIG. 9 is a schematic illustration of a further alternative mode of change in reeling in accordance with the invention.

FIG. 9 shows an example of change in reeling in which, by means of water-jet cutting equipment 71, a wedge shaped leader $W_N$ is formed on the web W supported by the belt F. The leader $W_N$ is either wound around the new reel spool 11' by means of an air-blow device 72 placed above, or the wedge-shaped leader $W_N$ is blown to begin winding around the new reel spool 11' by an air-blow device 73 blowing through the belt F which is permeable to air. Both of the air-blow devices 72,73 can also be used to wind the leader $W_N$ around the new reel spool 11'. In order to keep the web W in contact with the belt F, near the reeling cylinder 10, for example before the reeling cylinder 10, a suction zone 74 is provided before the reeling cylinder 10 and/or a suction zone 75 is provided in the reeling cylinder 10. Instead of the water-jet cutting equipment 71, a cutting slash can be made into the web W, in which case it is advantageous to use both the upper and the lower air-blow devices 72,73 to wind the leader $W_N$ of the web W onto the new reel spool 11'. The end $W_E$ of the web W runs supported by the belt F and is reeled onto the reel that is being completed.

The different modes of reel changing shown above in FIGS. 6–9 can be combined in various ways with respect to air-blows, center-drive slow-downs and cutting applications. Of course, the cutting can also be carried out by other means than the water-jet cutting devices shown in the illustrated embodiments. A cutting slash can also be made into the web before the reeling cylinder to enable the reel change.

The examples provided above are not meant to be exclusive. Many other variations of the present invention would be obvious to those skilled in the art, and are contemplated to be within the scope of the appended claims.

We claim:

1. Method for reeling a web in a drum reel-up, wherein a first reel spool is in a reeling position in nip-defining relationship with a reel drum and an empty second reel spool is placed in a stand-by position and accelerated up to web speed when the reel of the web formed on the first reel spool is complete, comprising the steps of:

carrying the web on a belt until it is reeled onto the first reel spool, guiding the belt in a run over the reel drum and a belt guide roll, and transferring the reeling of the web from the first reel spool to the second reel spool, said transferring step comprising displacing the first reel spool from the reeling position to an exchange position spaced from the reel drum, and displacing the belt guide roll into nip-defining relationship with the reel being formed on the first reel spool at the time the first reel spool is displaced to the exchange position so that the belt carries the web into the nip defined between the guide roll and the reel on the first reel spool and through the nip defined between the guide roll and the reel on the first reel spool.

2. The method of claim 1, further comprising the step of running the belt at a speed which is substantially the same speed as the speed of the web reeling onto the first reel spool.

3. The method of claim 1, wherein said transferring step further comprises the steps of transferring the second reel spool from the stand-by position to the reeling position when the first reel spool is displaced from the reeling position to the exchange position, and guiding the web around the second reel spool by moving a roll relative to the second reel spool to cause the belt to surround a substantial proportion of the circumference of the second reel spool such that the web reels onto the second reel spool.

4. The method of claim 1, wherein said transferring step further comprises the steps of transferring the second reel spool from the stand-by position to the reeling position when the first reel spool is displaced from the reeling position to the exchange position, forming a leader of the web and transferring the leader onto a face of the second reel spool such that the web reels onto the second reel spool.

5. The method of claim 4, wherein the web runs on the belt during the entire transfer of the reeling from the first reel spool to the second reel spool.

6. The method of claim 4, wherein the step of transferring the leader onto the face of the second reel spool comprises blowing the leader via an air-blow device.

7. The method of claim 4, wherein the final end of the web remaining after the leader has been cut into the web winds around the first reel spool.

8. The method of claim 1, wherein said transferring step further comprises the steps of transferring the second reel spool from the stand-by position to the reeling position when the first reel spool is displaced from the reeling position to the exchange position, and forming a leader of the web by directing a water-jet at the web and blowing air from an air-blowing device at the leader to directed the leader onto a face of the second reel spool such that the web reels onto the second reel spool.

9. The method of .claim 8, further comprising the step of applying suction in at least one suction zone to hold the web in contact with the belt during the changing of the reeling from the first reel spool to the second reel spool.

10. The method of claim 8, wherein the web runs on the belt during the entire transfer of the reeling from the first reel spool to the second reel spool.

11. The method of claim 8, wherein the final end of the web remaining after the leader has been cut into the web winds around the first reel spool.

12. A device for reeling a web in a drum reel-up including a reel drum and a first reel spool in nip-defining relationship with said reel drum when the web is reeled through the nip and onto said first reel spool, and a transfer device for moving an empty second reel spool into nip-defining relationship with said reel drum after the reel on said first reel spool is complete, comprising a belt for supporting the web and carrying the web over the reel drum, a movable belt guide roll arranged in a loop of said belt, said belt guide roll being movable into nip-defining relationship with the reel on said first reel spool, and means for displacing said belt guide roll and said first reel spool when defining a nip therebetween into an exchange position such that the web is supported on said belt and runs through the nip between said belt guide roll and the reel on said first reel spool.

13. The device of claim 12, further comprising a plurality of guide rolls arranged in the loop of said belt, and means for displacing at least one of said guide rolls to adjust the tension of said belt.

14. The device of claim 12, further comprising cutting means for cutting the web to form a leader when the paper or board reel on said first reel spool is complete and said second reel spool is in nip-defining relationship with said reel drum, and means for transferring the leader of the cut web onto a face of said second reel spool such that the web winds thereon.

15. The device of claim 14, wherein said leader transferring means comprise an air-blow device for blowing the leader of the cut web.

16. The device of claim 12, further comprising a movable roll arranged in a loop of said belt, said movable roll being displaceable relative to said second reel spool when in the reeling position to cause said belt to surround a substantial proportion of the circumference of the second reel spool.

17. The device of claim 16, further comprising cutting means for cutting the web against said movable roll, and blowing means arranged after said cutting means in a running direction of said belt to blow air against said movable roll and cause the web to wind around said second reel spool.

18. The device of claim 17, further comprising at least one suction zone arranged in connection with or in proximity to said reel drum to maintain the web in contact with said belt.

19. The device of claim 12, further comprising cutting means arranged before the reel drum in a running direction of said belt for cutting the web to form a leader, and air-blow means for winding the leader of the cut web around said second reel spool.

20. The device of claim 12, wherein said belt is a wire, felt or an air-permeable fabric.

* * * * *